US010723368B2

(12) United States Patent
Sutterluety et al.

(10) Patent No.: US 10,723,368 B2
(45) Date of Patent: Jul. 28, 2020

(54) CLAMP

(71) Applicant: INNOVA PATENT GMBH, Wolfurt (AT)

(72) Inventors: Andreas Sutterluety, Egg (AT); Josef Sutter, Bregenz (AT)

(73) Assignee: Innova Patent GmbH, Wolfurt (AT)

( * ) Notice: Subject to any disclaimer, the term of this patent is extended or adjusted under 35 U.S.C. 154(b) by 248 days.

(21) Appl. No.: 15/769,384

(22) PCT Filed: Sep. 21, 2016

(86) PCT No.: PCT/EP2016/072444
§ 371 (c)(1),
(2) Date: Apr. 19, 2018

(87) PCT Pub. No.: WO2017/067731
PCT Pub. Date: Apr. 27, 2017

(65) Prior Publication Data

US 2018/0304908 A1 Oct. 25, 2018

(30) Foreign Application Priority Data

Oct. 19, 2015 (AT) ..... A 677/2015

(51) Int. Cl.
*B61B 12/12* (2006.01)

(52) U.S. Cl.
CPC ..... *B61B 12/122* (2013.01)

(58) Field of Classification Search
CPC ..... B61B 12/12; B61B 12/122
See application file for complete search history.

(56) References Cited

U.S. PATENT DOCUMENTS

| | | | | | |
|---|---|---|---|---|---|
| 3,037,464 | A * | 6/1962 | Penney | B61B 12/127 | 104/209 |
| 3,662,691 | A * | 5/1972 | Goirand | B61B 12/122 | 104/173.1 |
| 4,573,414 | A * | 3/1986 | Cantin | B61B 12/12 | 104/202 |
| 4,608,930 | A * | 9/1986 | Galmiche | B61B 12/127 | 104/180 |
| 5,452,662 | A * | 9/1995 | Switzeny | B61B 12/122 | 104/206 |
| 2018/0304908 | A1* | 10/2018 | Sutterluety | B61B 12/122 | |

FOREIGN PATENT DOCUMENTS

| | | | |
|---|---|---|---|
| CN | 203651755 | U | 6/2014 |
| CN | 104787054 | A | 7/2015 |
| CO | 7030190 | A1 | 8/2014 |
| DE | 2652315 | A1 | 5/1978 |
| EP | 0132721 | A1 | 2/1985 |
| EP | 0456588 | A1 | 11/1991 |

(Continued)

*Primary Examiner* — Jason C Smith
(74) *Attorney, Agent, or Firm* — Laurence A. Greenberg; Werner H. Stemer; Ralph E. Locher

(57) ABSTRACT

A clamp for a cable-drawn transport device includes clamp jaws having a clamp spine and clamping tongues adjoining the clamp spine. The clamp spine and the clamping tongues form running surfaces for rollers. In the longitudinal direction, the clamping tongues have a substantially S-shaped curved running surface, which merges continuously into the running surface of the clamp spine.

19 Claims, 3 Drawing Sheets

(56) References Cited

FOREIGN PATENT DOCUMENTS

| | | | |
|---|---|---|---|
| EP | 0621163 | A1 | 10/1994 |
| FR | 2675451 | A1 | 10/1992 |
| FR | 2768112 | A1 | 3/1999 |
| JP | S6085056 | A | 5/1985 |
| JP | H0340160 | U | 4/1991 |
| JP | H03292252 | A | 12/1991 |
| JP | H0445173 | U | 4/1992 |
| JP | H05162637 | A | 6/1993 |
| JP | H072094 | A | 1/1995 |
| RU | 2471663 | C1 | 1/2013 |
| SU | 1382705 | A1 | 3/1988 |
| SU | 1773763 | A1 | 11/1992 |
| WO | 2014125423 | A1 | 8/2014 |

* cited by examiner

CLAMP

BACKGROUND OF THE INVENTION

Field of the Invention

The invention relates to a clamp for a cable-drawn transporting means, having a clamp spine and clamp tongues adjoining the same, wherein the clamp spine and the clamp tongues have running surfaces for sheaves.

The invention also relates to a cable-drawn transporting means, for example a chair of a chair lift or a cable car, having an accommodating region for people and/or objects and having a connecting device for connecting the accommodating region to a cable, and to a cableway system having at least two stations, wherein transporting means connected to a cable can be transported between the stations.

In cableways, it is very often the case that supports with sheave assemblies are used between stations, wherein the clamps in some cases travel over and in some cases travel beneath these sheave assemblies. This means that the clamps of the transporting means are moved over, above, the sheaves of the sheave assemblies or are moved through beneath the same. The clamps here are usually designed such that they engage over the cable from above, as a result of which the clamps project beyond the lower region of the cable to a lesser extent than they do beyond the upper region and, consequently, are less problematic when they travel over a sheave assembly than when they travel beneath the same. However, it is also possible for the clamps to engage over the lower region of the cable, it also being possible for the invention to be used without restriction for clamps of this kind.

As a result, when the clamps travel beneath a sheave assembly, it is not just the individual components of the sheave assembly, but also the components of the transporting means, which are subjected to more pronounced mechanical loading; in addition, passengers find the vibrations uncomfortable.

In order to reduce the negative effect of these vibrations, clamps for cable-drawn transporting means therefore have so-called clamp tongues, which extend, in the upper region of the cable and/or of the clamps, upstream and downstream of the clamps, as seen in the longitudinal direction of the cable, in order to provide for the sheaves to run more smoothly onto the clamp spine, and off from the clamp spine, when the clamps are moved through beneath the sheaves.

The invention is based on the object of improving the geometry of said clamp tongues in order to provide for the sheaves to roll as smoothly as possible over the clamp spine.

SUMMARY OF THE INVENTION

This object is achieved by a clamp as claimed.

The fact that the running surface of the clamp tongues is curved in an S-shaped manner and merges continuously, and/or with constant curvature, into the running surface of the clamp spine optimizes the dynamic system behavior, i.e. the interaction of the sheaves or sheave assemblies with the clamps on the cable, in that any abrupt acceleration of the system components during travel beneath a sheave assembly with holding-down action is reduced.

The running surface of the clamp tongues preferably has a positive curvature in the region of the free ends of said clamp tongues and a negative curvature following the same, wherein a turning point is located between said curvatures.

It is further preferred here if the positive curvature has a maximum in the central region between the turning point and the free end and/or if the positive curvature at the free end of the clamp tongue is essentially zero.

This gives rise to a continuous acceleration behavior of the sheave-assembly running sheaves rolling over the clamp and the clamp tongues and of the clamp along with the transporting means.

Further preferred embodiments of the invention form the subject matter of the rest of the dependent claims.

BRIEF DESCRIPTION OF THE SEVERAL VIEWS OF THE DRAWING

Further features and advantages of the invention can be gathered from the following description of preferred embodiments of the invention with reference to the attached drawings, in which.

DESCRIPTION OF THE INVENTION

Figure 1:
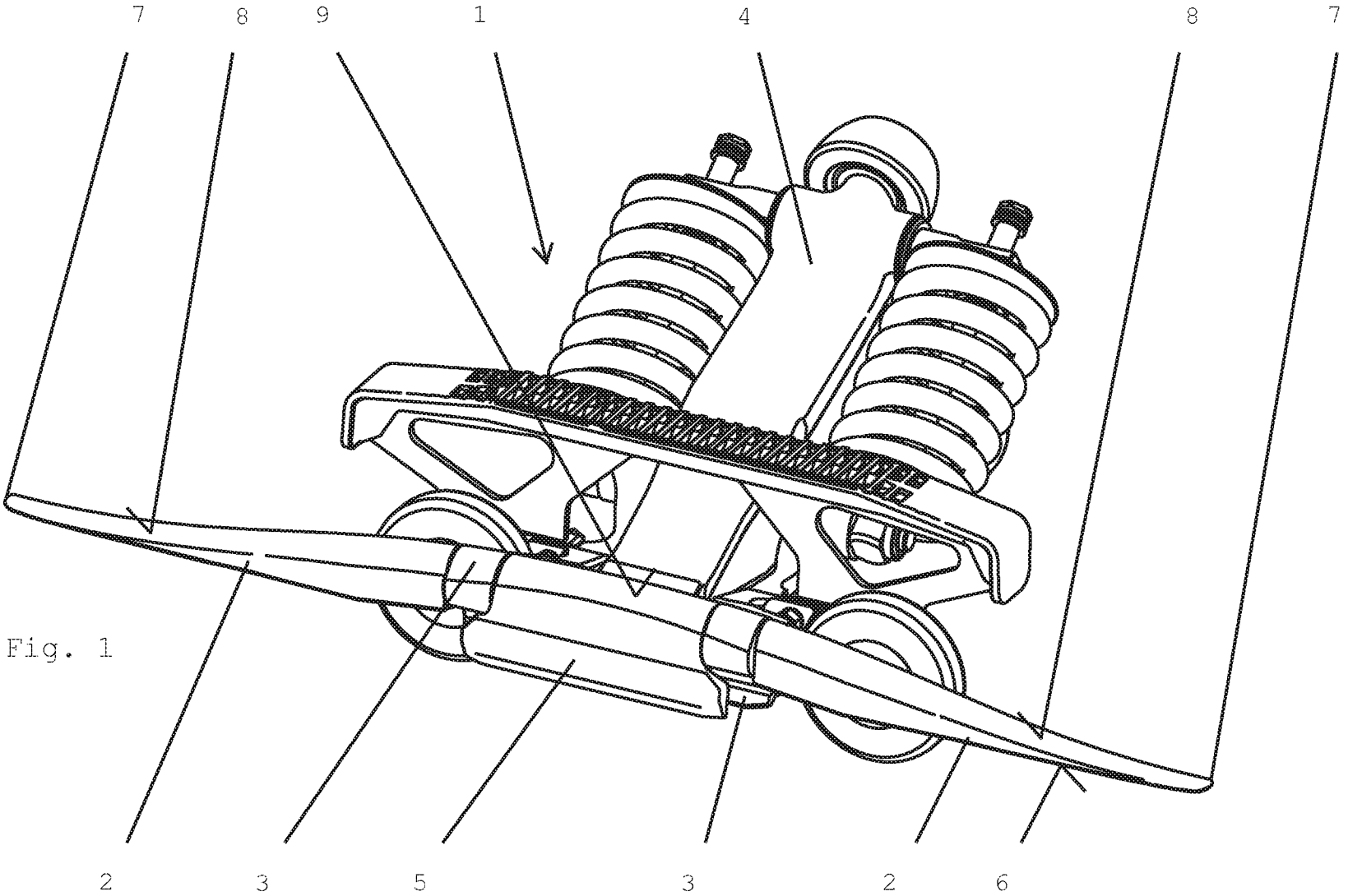
FIG. 1 shows an embodiment of a clamp according to the invention which has clamp tongues and is in the form of a coupling clamp.
Figure 2:
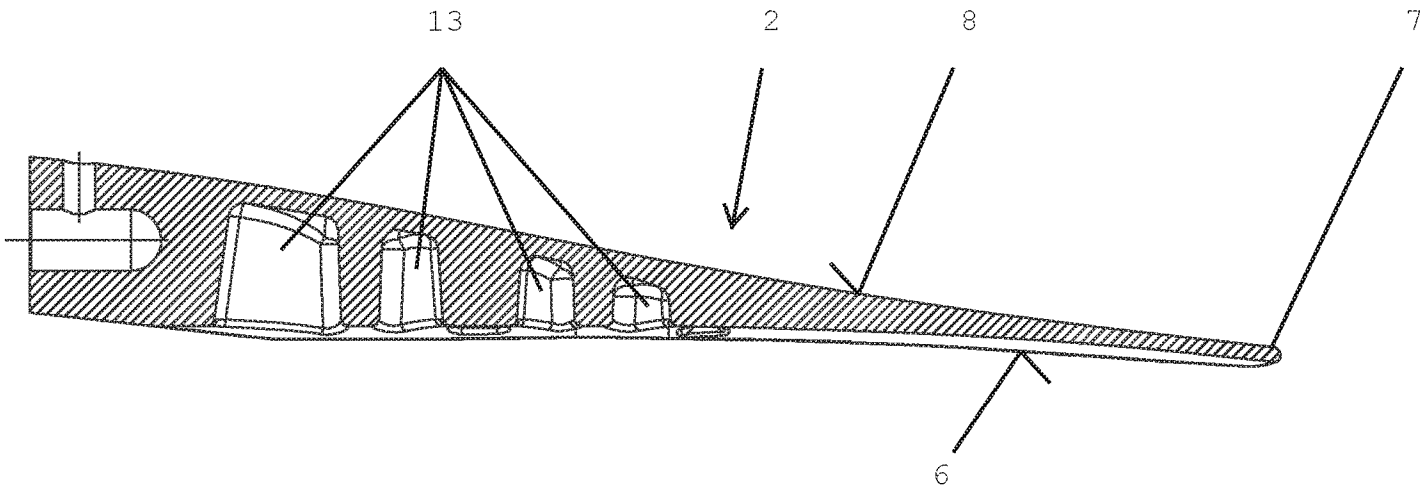
FIG. 2 shows an embodiment of a clamp tongue in section.
Figure 3:
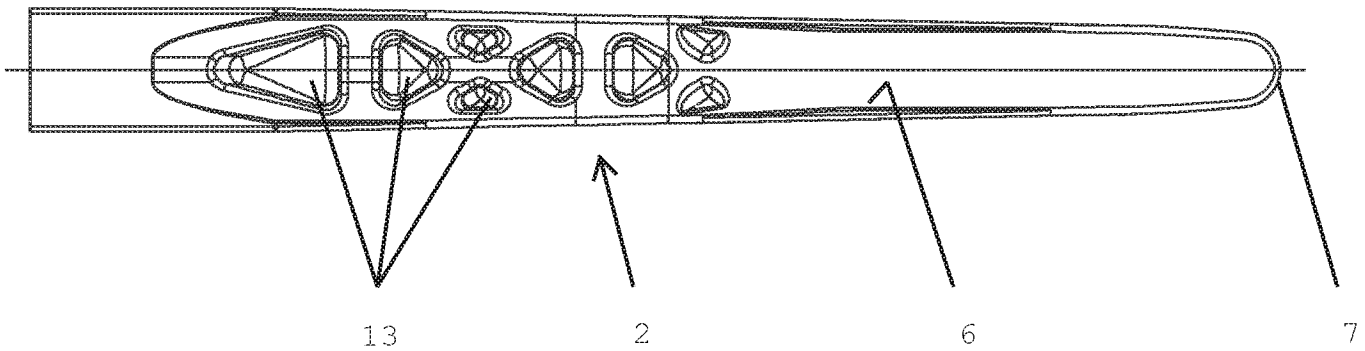
FIG. 3 shows a view from beneath of the clamp tongue from FIG. 2.

FIG. 1 shows a clamp 1 according to the invention which, in the embodiment illustrated, is a so-called coupling clamp and, as it travels through a station, is detached from the cable to which it is clamped as it travels its route. The type of clamp, however, is not essential to the present invention. It is therefore also possible for the clamp to be, for example, a clamp which, although connected in a releasable manner to the cable, is not detached from the cable as it travels through a station or to be a clamp which is fixed to the cable by casting. Since these types of clamps, moreover, are well known from the prior art, they will not be described in any more detail.

Since a clamp 1, of whatever type, has to engage over the cable, in order therefore to be connected permanently or temporarily, it forms an elevation or an obstruction both for an individual sheave for the cable and for sheaves of a sheave assembly, and this elevation or obstruction causes jolting when the clamp travels over the sheaves. In order to reduce or to minimize this jolting, clamps 1 therefore have clamp tongues 2, which provide for the sheaves to run more smoothly onto the clamp 1 and off from the clamp 1.

If the clamp 1, as in the embodiment illustrated, is a coupling clamp, the clamp tongues 2 are fastened on a fixed clamping jaw 3 of the clamp 1. The cable (not illustrated in the drawings) is clamped between a clamping jaw 5, which can be moved via a lever 4, and the fixed part 3 of the clamp 1. The clamp tongues 2 have their lower bearing surface 6 resting on the cable.

When the clamp 1 travels over a sheave, it is only the clamping jaws 3, 5 which come into contact, in the region of their lower peripheries, with the sheave, wherein the amount of jolting which occurs is considerably smaller than when the clamp 1 travels beneath a sheave, since the clamp 1 projects beyond the upper side of the cable to a considerable extent. The sheave here runs first of all onto one end 7 of a clamp tongue 2 and then rolls along on a running surface 8, on the side located opposite the cable, to a running surface 9 on a clamp spine of the clamping jaws 3, 5, whereupon it runs off from the clamp 1 again on the running surface 8 of the other clamp tongue 2. In the case of that embodiment of the clamp 1 which is illustrated in FIG. 1, the running surface 9 on the clamp spine is formed to some extent by the movable clamping jaw 5 of the clamp 1 and also by the fixed clamping jaw 3 of the clamp 1. As seen in section, the running surfaces 8, 9 are curved transversely to the longitudinal extent of the clamp tongues.

In order that the sheave can run in as jolting-free a manner as possible over the running surfaces 8, 9 on the clamp tongues 2 and the clamp spine, as seen in the longitudinal direction, the clamp tongues 2 have a running surface 8 which is curved in an essentially S-shaped manner and merges continuously, and/or with constant curvature, into the running surface 9 of the clamp spine.

The running surface 8 of the clamp tongues 2 has a positive curvature Kp in the region of the free ends 8 of said clamp tongues and a negative curvature Kn following the same, that is to say on the side directed toward the clamping jaw 3. Positive curvature, within the context of the present invention, means that the center point of curvature of the running surface 8 is located above the clamp tongue 2, that is to say on that side of the clamp tongue 2 which is directed away from the cable. Negative curvature therefore means that the center point of curvature of the running surface 8 is located on that side of the clamp tongue 2 which is directed toward the cable.

A turning point 10 is located between said curvatures Kp, Kn, the turning point preferably being located in the region of that half of the clamp tongues 2 which is directed toward the clamp spine. It is also possible, however, to provide a short rectilinear portion, on which the turning point 10 is located.

The running surface 9 on the clamp spine likewise has a negative curvature, into which the negative curvature Kn of the running surface 8 of the clamp tongues 2 merges continuously.

Figure 4:
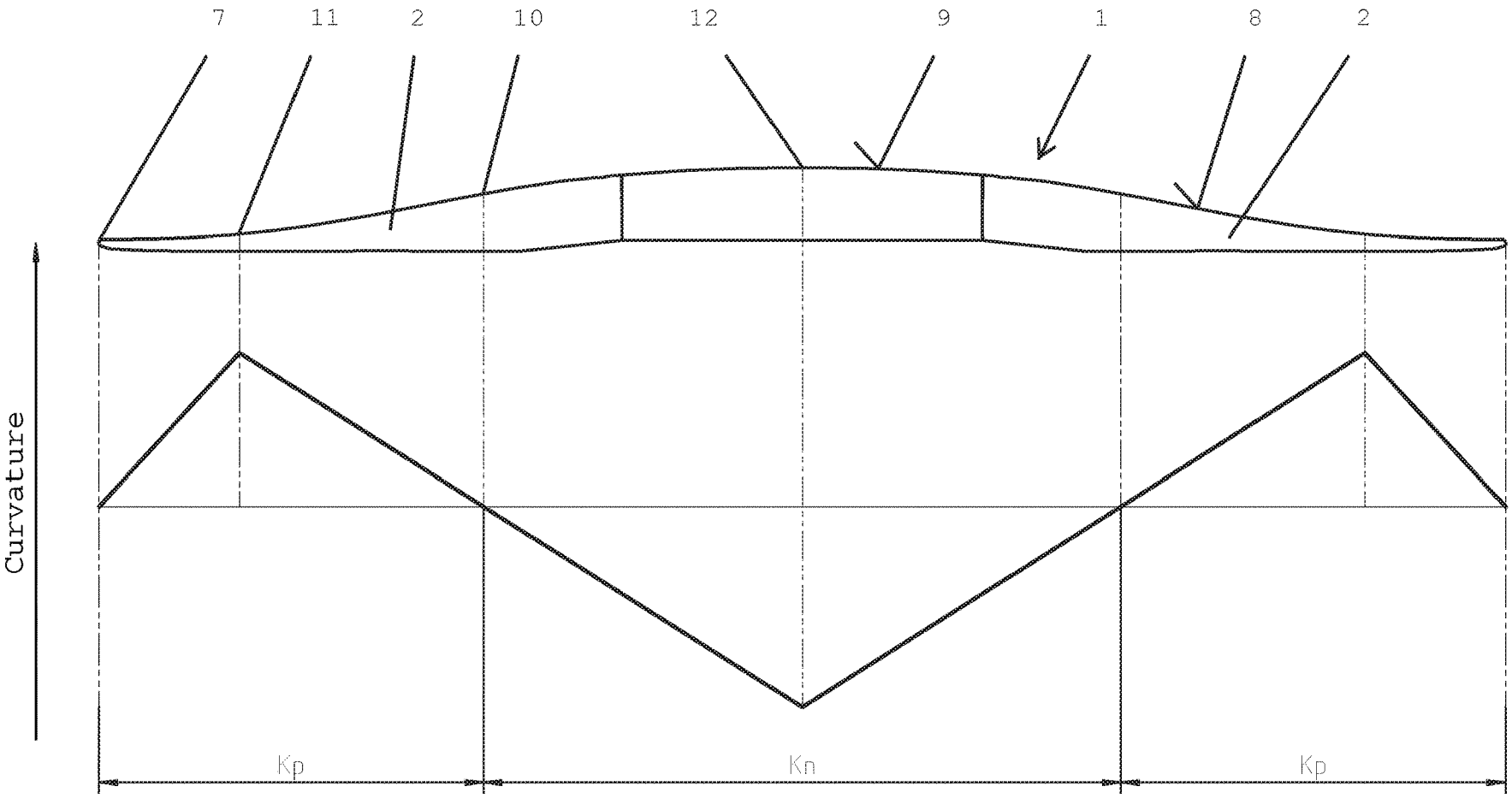
FIG. 4 shows a diagram showing the progression of the curvature over the length of the clamp with the clamp tongues.

FIG. 4 is used to describe a particularly preferred embodiment of the curvature of the running surfaces 8, 9, which provides for the sheaves of a sheave assembly to roll particularly smoothly on the clamp 1, wherein one or more of the curvature-related details described hereinbelow may also be rendered differently.

The positive curvature Kp has a maximum approximately in the central region between the turning point 10 and the free end 7 and is essentially zero at the free end 7 of the clamp tongues. The positive curvature Kp increases continuously, preferably linearly, from the free end to the maximum, as is illustrated in the diagram of FIG. 4. This means that the radius of curvature at the end 7 of the clamp tongue 2 is essentially endless and reaches a maximum at the point 11, at which the radius of curvature is smallest.

Thereafter, the positive curvature Kp decreases continuously, preferably linearly, from the maximum at the point 11 to the turning point 10, reaches zero again there and merges into a negative curvature Kn, until, in the central region 12 of the clamp spine, a maximum, in this case a negative maximum, is reached again. Here too, the negative curvature increases continuously, preferably linearly, from the turning point 10 to the maximum 12 on the clamp spine.

Although a linear increase and decrease is preferred, it would be possible for the curvatures to increase and/or decrease non-linearly in all cases or also just in some cases. In addition, rectilinear portions may be contained between the individual portions with positive or negative curvature, but also within said portions.

It is further preferred, in the case of the invention, if the positive curvature Kp increases to a more pronounced extent from the free end of the clamp tongue to the maximum 11 than it decreases from the maximum 11 to the turning point 10, and if the negative curvature increases to a less pronounced extent from the turning point 10 to the maximum 12 on the clamp spine than from the free end 7 of the clamp tongue 2 to the maximum 11 on the clamp tongue. Here too, the increase and decrease could be rendered differently in all cases or also just in some cases.

The clamp tongues 2 are made preferably from plastic, wherein, for reasons relating to saving weight and/or in order to improve the elastic or damping properties, recesses 13 may be provided in the main clamp-tongue body. The free ends 7 of the clamp tongues are preferably rounded, wherein the positive curvature Kp adjoins the rounded region.

The invention claimed is:

1. A clamp for a cable-drawn transport device, the clamp comprising:

clamping jaws with a clamp spine and clamp tongues adjoining said clamp spine;

said clamp spine and said clamp tongues having running surfaces forming a continuous running surface for sheaves;

each of said clamp tongues, in a longitudinal direction of the clamp, having the running surface with a substantially S-shaped curvature and the running surface of each of said clamp tongues merges into the running surface of said clamp spine and forms a continuous curvature with the running surface of said clamp spine; and wherein wherein said running surface of said clamp tongues is defined with a positive curvature at free ends of said clamp tongues and a negative curvature following said positive curvature towards said clamp spine.

2. The clamp according to claim 1, wherein said running surface is defined with an inflection between said positive and negative curvatures.

3. The clamp according to claim 2, wherein said inflection is located inside a half of said clamp tongue near said clamp spine.

4. The clamp according to claim 2, wherein said running surface on said clamp spine has a negative curvature.

5. The clamp according to claim 4, wherein said positive curvature has a maximum in a center between said inflection and the free end.

6. The clamp according to claim 1, wherein the positive curvature at the free end of said clamp tongues is substantially zero.

7. The clamp according to claim 1, wherein the free ends of said clamp tongues are rounded ends and the positive curvature adjoins the rounding of said rounded ends with a negative curvature.

8. The clamp according to claim 1, wherein the positive curvature increases continuously from said free end to a maximum in a center between said inflection and said free end.

9. The clamp according to claim 1, wherein said positive curvature decreases continuously from a maximum thereof in a center between said inflection and said free end to the inflection.

10. The clamp according to claim 9, wherein an increase of the positive curvature from the free end of said clamp tongue to the maximum is move pronounced that a decrease from the maximum to said inflection.

11. The clamp according to claim 1, wherein the negative curvature in a central region of the clamp spine has a maximum.

12. The clamp according to claim 11, wherein the negative curvature increases continuously from said inflection to the maximum on said clamp spine.

13. The clamp according to claim 11, wherein the negative curvature increases to a lesser extent from said inflection to the maximum on said clamp spine than from the free end of said clamp tongue to the maximum on said clamp tongue.

14. The clamp according to claim 1, wherein said clamp tongues have a bearing surface for a cable, said bearing surface being opposite said running surface.

15. The clamp according to claim 14, wherein said bearing surface of said clamp tongue is formed with at least one recess.

16. The clamp according to claim 1, comprising two clamp jaws including one immovable clamp jaw connected to said clamp tongues.

17. The clamp according to claim 1, comprising rectilinear portions disposed between individual said portions having the positive or negative curvature, and/or within said portions.

18. A cable-drawn transport device for transporting persons and/or goods, the transport device comprising connecting device for connection to a cable, said connecting device including a clamp according to claim 1.

19. A cableway system, comprising at least two stations and transport devices connected to a cable form movement between said stations, said transport devices each having a clamp according to claim 1.

* * * * *